United States Patent [19]

Zobel

[11] 3,960,096

[45] June 1, 1976

[54] APPARATUS AND METHOD FOR THE MANUFACTURE OF FACE MASKS

[76] Inventor: James W. Zobel, P.O. Box 125, Mount Kisco, N.Y. 10549

[22] Filed: Dec. 30, 1974

[21] Appl. No.: 537,262

[52] U.S. Cl. ..... 112/121.11; 112/265; 2/9

[51] Int. Cl.[2] ..... D05B 19/00

[58] Field of Search ..... 112/121.11, 121.29, 112/262, 265, 10, 165, 429, 432, 431, 436; 128/146, 146.2; 2/9

[56] References Cited

UNITED STATES PATENTS

| | | | |
|---|---|---|---|
| 2,494,406 | 1/1950 | Reitano | 128/146.2 |
| 3,084,641 | 4/1963 | Phillips et al. | 112/262 |
| 3,580,198 | 5/1971 | Teed et al. | 112/121.11 |
| 3,750,605 | 8/1973 | Warburton et al. | 112/265 |

*Primary Examiner*—Werner H. Schroeder
*Assistant Examiner*—Peter Nerbun
*Attorney, Agent, or Firm*—Roberts & Cohen

[57] ABSTRACT

A face mask comprising an elongated sheet of porous material having upper and lower longitudinal edges and transverse side edges. A line of stitches of elastic material is sewn to the material along both its side edges, and a length of elastic cord at each side edge is secured to the material by interweaving with the line of stitches thereat. A free intermediate portion of the elastic cord is formed between the ends at which the cord is interwoven with the stitches to the porous material, and the free intermediate portion forms an ear loop. The elastic material is sewn to the porous material and interwoven with the cord lengths while the porous material is taut so that when the porous material is relaxed, the elastic material exerts a pull on the porous material to gather and contract the material at the side edges. In the manufacture of the masks, the porous material is continuously withdrawn from a roll thereof by drive rollers and advanced through a sewing machine where the line of stitches is continuously sewn along each of the opposite side edges of the material while the material is taut. The cord is periodically interwoven along each side edge with the line of stitches, and a cutter downstream of the sewing machine cuts the porous material transversely thereof at successive spaced locations at which the cord is interwoven with the line of stitches.

14 Claims, 13 Drawing Figures

FIG.10
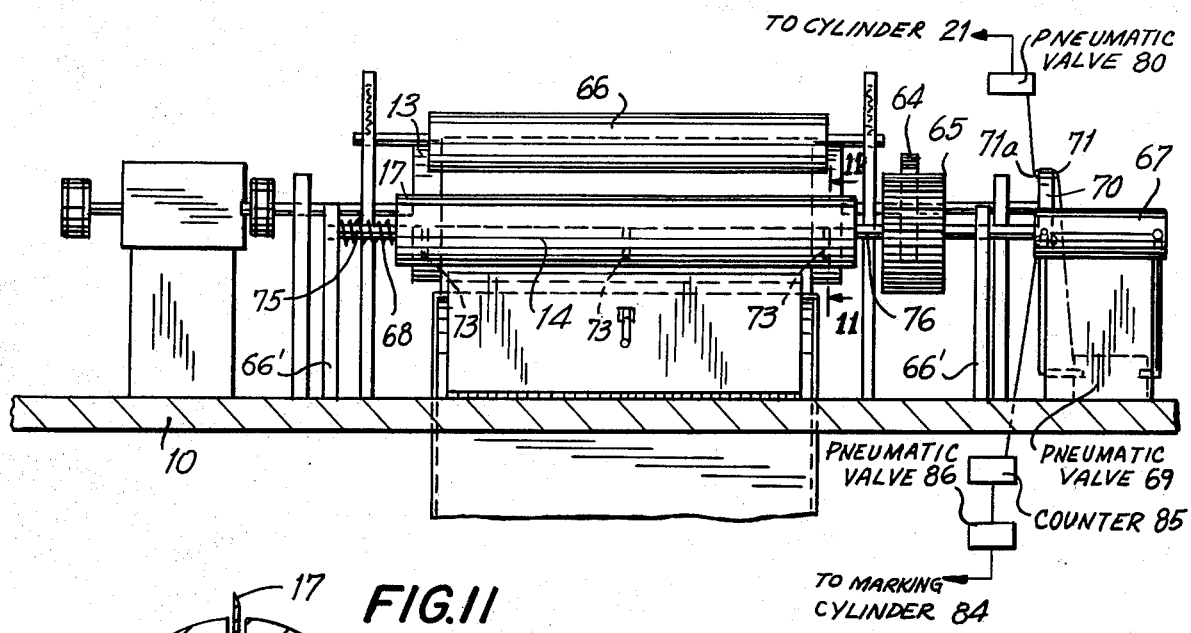
FIG.11
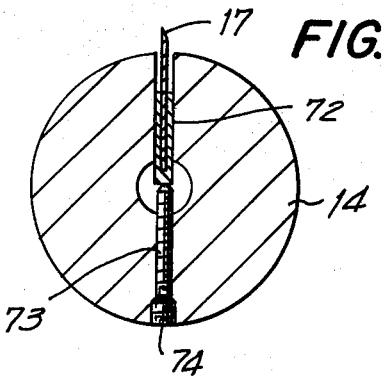
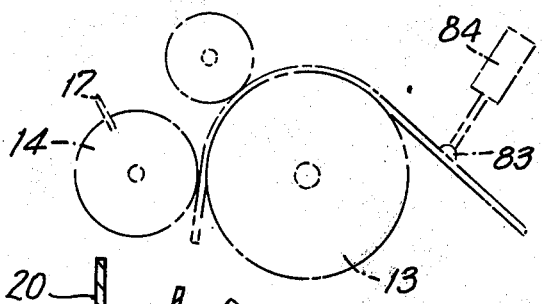
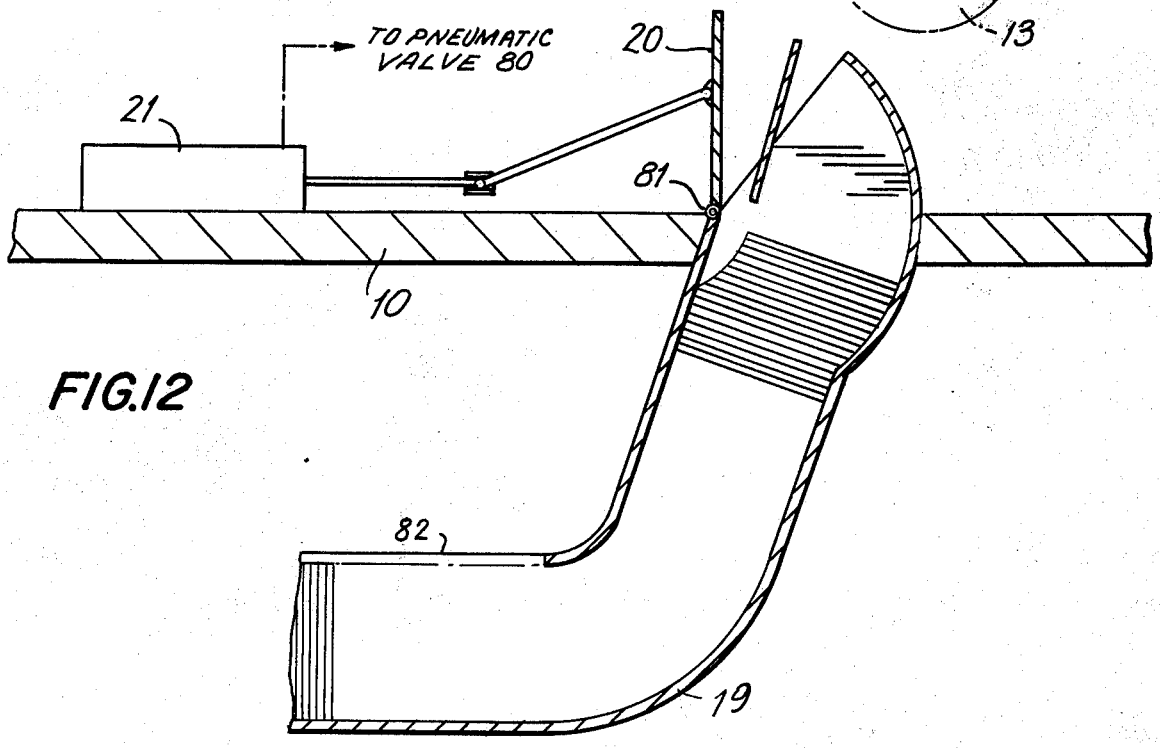
FIG.12

APPARATUS AND METHOD FOR THE MANUFACTURE OF FACE MASKS

FIELD OF THE INVENTION

The invention relates to face masks of the surgical type and to methods and apparatus for the manufacture thereof.

BACKGROUND

Surgical masks are known in which ear loops attached to the sides of the mask are intended to be engaged over the ears of the user while the body of the mask is fitted over the nose and mouth of the user. Although such masks are designated as "surgical" masks, it is to be understood that they are not limited to such use but are adapted for much wider general usage wherever a mask of filter material is to be worn.

The attachment of such loops to the mask material poses a problem in the manufacture and use of the mask since in the application of the ear loops on the ears of the user, substantial tearing forces are developed on the mask material. If the mask material is paper, it is frequently torn rendering the mask unusable. The problem is accentuated when the ear loops are made of elastic material.

It has been known to sew the ear loops onto the masks and this is a slow unreliable procedure which produces a large percentage of rejects since the operation is dependent on the skill of the particular operator. It is difficult for the operator to manually place the ear loop material on the mask material to affix the same by stitching on a sewing machine and the attachment is unreliable.

Another approach has been to continuously form the ear loop material as a chain stitch and to weave the chain stitch onto the side edges of the mask proximate the upper and lower longitudinal edges while leaving the chain stitch material free in an intermediate region, this free length of chain stitch material serving as the ear loops proper. However, this has not proven satisfactory as the chain stitch material lacks the necessary elasticity required for the ear loops. If the chain stitch material is elastic, then it cannot provide the necessary anchoring to the mask material to resist the pulling forces developed when the ear loops are stretched around the ears of the user.

SUMMARY OF THE INVENTION

An object of the invention is to provide a face mask of the above type which is free of the disadvantages and problems noted hereinabove.

A further object of the invention is to provide apparatus for the manufacture of face masks which will reliably produce masks of high quality with relatively few rejects.

A further object of the invention is to provide a method for the production of such masks which requires a minimum of manual intervention and wherein the masks are successively produced from a continuous roll of mask material.

Another object of the invention is to provide a combination cutting and pulling means for continuously unwinding the mask material from the roll under tension and cutting successive masks therefrom.

According to the invention a face mask is provided which comprises an elongated sheet of porous material having upper and lower longitudinal edges and transverse side edges, a line of stitches of elastic material sewn to said material along both side edges, and a length of cord at each side edge secured to said material by the line of stitches thereat, each length of said cord having opposite ends which are interwoven with said line of stitches and a free intermediate portion between said ends which forms an ear loop, said elastic material being sewn to said porous material and interwoven with said cord lengths when the porous material is taut such that when the porous material is relaxed, the elastic material exerts a pull on the porous material to gather and contract the material at the side edges.

Preferably, the cord is constituted of elastic material and it also serves to gather and contract the material at said side edges.

The cord is woven with the associated line of stitches such that it alternately passes on opposite sides thereof in sinusoidal fashion.

In further accordance with the invention there is provided apparatus for producing face masks from a roll of porous material, comprising means for rotatably supporting the roll of material to permit unwinding thereof, driven roller means for pulling the material to unwind the material from the roll in taut condition, a sewing machine for forming a longitudinal line of stitches along each of the opposite side edges of the material while the material is taut, means for periodically interweaving a cord along each side edge with the line of stitches to form alternate interwoven cord portions and intervening free loops of said cord, and cutter means for cutting the material transversly thereof at successive spaced locations at which the cord is interwoven with the line of stitches whereby to separate successive sections of porous material, with said loops of cord attached thereto, constituting face masks.

Said driven roller means comprises a pair of rollers between which the porous material is caused to advance, said cutter means comprising a blade secured in one of said rollers, which is supported for transverse reciprocation, and means is provided for reciprocably moving said one roller when the blade faces the other roller to effect a cutting action on said material.

The invention further contemplates a method of producing face masks from a roll of porous material comprising continuously unwinding the material from said roll while holding the material taut, sewing a continuous line of stitches along both lateral edges of the material in the course of unwinding thereof, periodically interweaving a continuous elastic cord with each line of stitches in longitudinally spaced regions therealong while leaving said cord free between successive regions to form an ear loop thereat, and transversely cutting said material at successive locations through said regions where the cords are interwoven to separate successive sections of material with ear loops at its opposite edges constituting face masks.

BRIEF DESCRIPTION OF THE DRAWING

FIG. 10 is an end view of the machine showing the feed means for the paper and the cutting means for the masks, FIG. 11 is a sectional view on enlarged scale taken along line 11—11 in FIG. 10, FIG. 12 is a sectional view of a portion of the machine showing a marking device and a mask stacking means.

DETAILED DESCRIPTION

Figure 2:
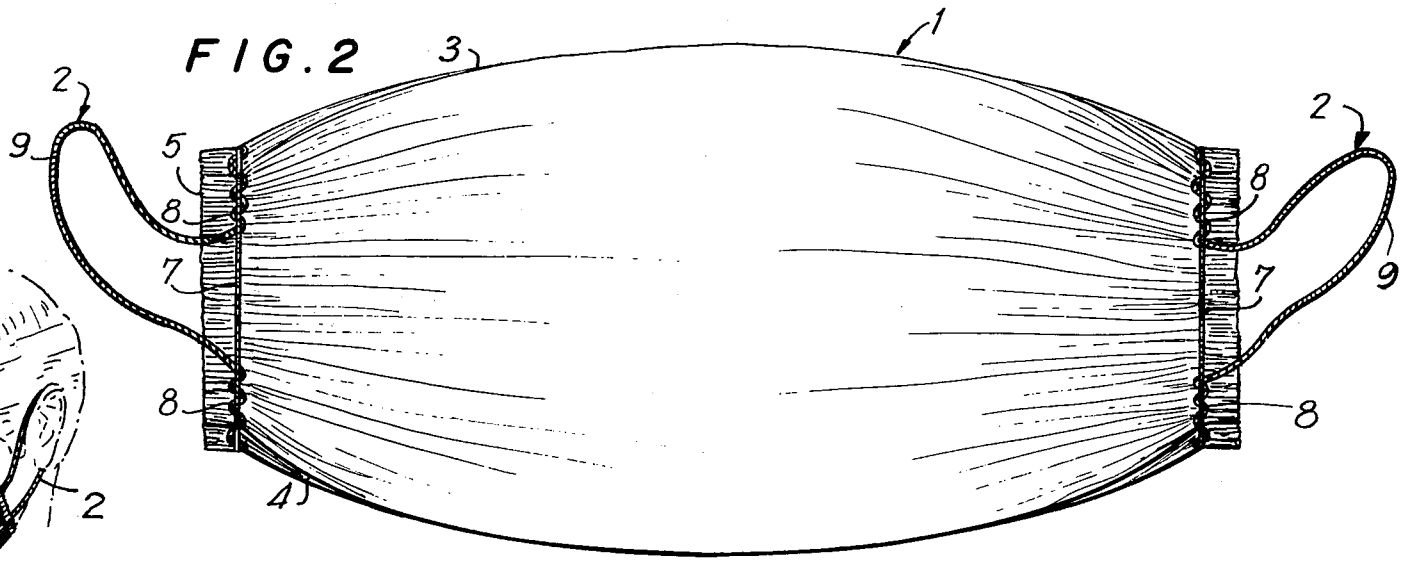
FIG. 2 is a plan view of the mask from the inside thereof.
Figure 3:
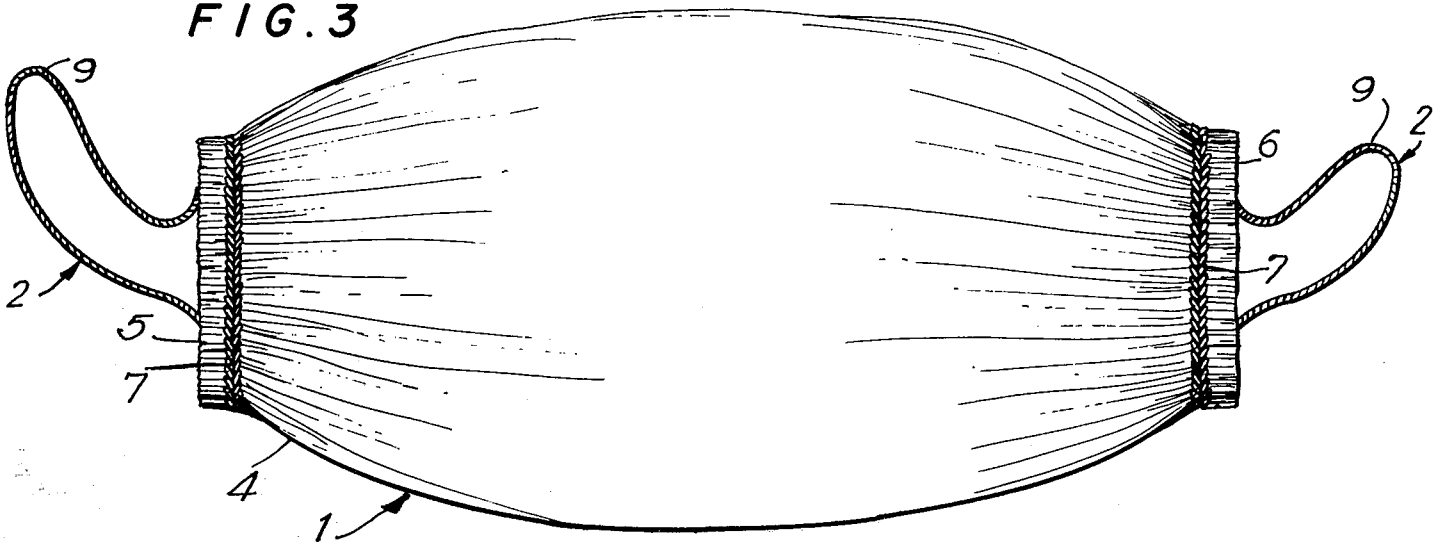
FIG. 3 is a plan view of the mask from the outside thereof.
Figure 1:
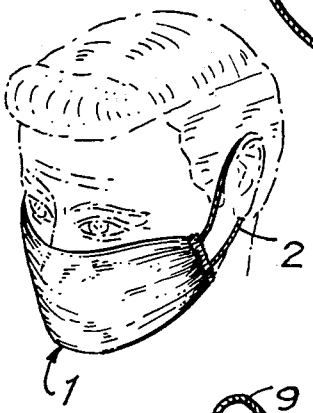
FIG. 1 is a perspective view showing the face mask according to the invention in a position of use.

Referring to FIGS. 1–3 of the drawing, therein is shown a face mask 1 which comprises a main portion of porous material adapted for covering the nose and mouth of the wearer in use as seen in FIG. 1 with a pair of ear loops 2 adapted for being supported around the ears of the wearer.

The porous material is preferably a paper material and specifically, a porous-fiber type paper of flameproof construction. The porous material can be single-ply or multi-ply as desired. The loops 2 are elastic cords, specifically, cotton-covered elastic interwoven material.

The porous material of the mask has upper and lower longitudinal edges 3 and 4 and transverse side edges 5 and 6. A line of stitches 7 of elastic thread material is sewn to the porous material along both side edges. More particularly, the elastic thread material is a single thread chain stitch formed in a manner to be explained more fully later. The elastic cords for the ear loops are secured along each of the side edges of the mask by the line of stitches 7 thereat. Specifically, each length of the cord has opposite ends which are interwoven at 8 with the line of stitches 7 and a free intermediate portion 9 is formed between the ends 8 to constitute the ear loop proper.

The chain stitches 7 are sewn to the porous material and the ends 8 of the cords are interwoven with the chain stitches 7 when the porous material is taut so that when the porous material is subsequently relaxed, the elastic chain stitch material exerts a pull on the porous material to gather and contract the porous material at the side edges in the manner as evident from FIGS. 2 and 3. Such gathering has the effect of narrowing the edges while leaving the center of the mask substantially undeformed. This facilitates the use of the mask and the ease with which it can be put on and taken off.

Because the cord material of the loops is also constituted of elastic material, it also serves to gather and contract the material at the side edges. Additionally, it enables the loops to be expanded to be fitted over the user's ears.

In order that the cords of the ear loops are properly anchored to the mask, the cord material is woven in sinusoidal fashion along the stitch line 7 in a manner to be more fully explained later.

By virtue of the interwoven relation of the ear loop cords and the chain stitches, the pull exerted on the loops to fit the same around the ears will have minimized strain on the paper of the mask. In conventional masks, wherein the ear loop material itself has been directly stitched to the mask material, it is a common disadvantage that the ear loops tear away from the paper when a stress is placed on the loops.

Figure 4:
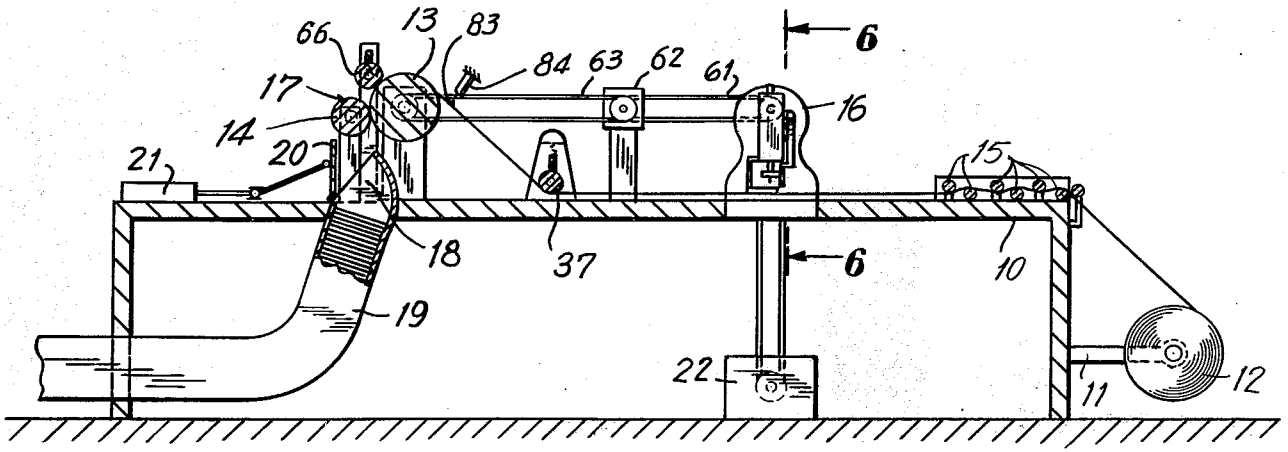
FIG. 4 is a diagrammatic side elevation view of a machine according to the invention for making the masks.
Figure 5:
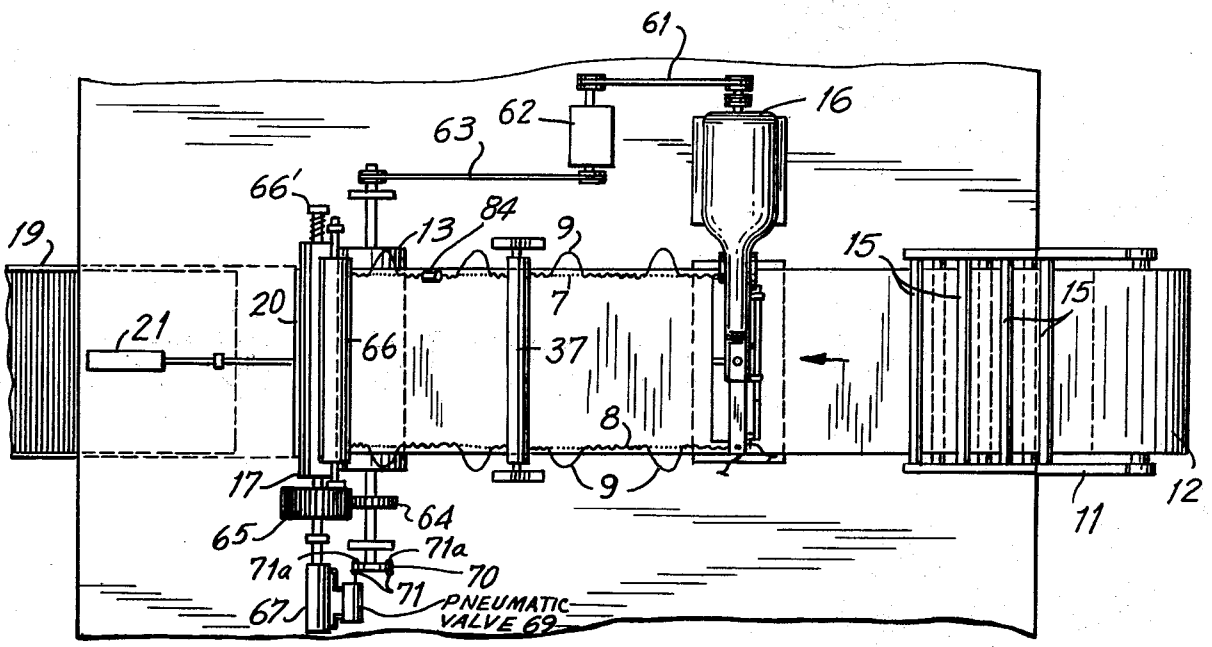
FIG. 5 is a top plan view of the machine.

Referring to FIGS. 4 and 5 of the drawing, therein is seen a machine for manufacturing the masks as described above. The machine comprises a table 10 which carries a support 11 for a roller of the porous mask material 12. The porous material 12 is pulled under the action of a main drive roller 13 and a second drive roller 14 in the direction shown by the arrow in FIG. 5. As the material is wound from roll 12 it passes along guide rollers 15 and then through a sewing machine 16 whereat the lines of chain stitches 7 are sewn and the ear loop cord material 2 is interwoven with the chain stitches 7 at 8 while free loops 9 are left therebetween. The material thus formed is fed between rollers 13 and 14 whereat the material is cut along a transverse line midway of the length 8 of the interwoven cord material. The cutting of the material is effected by a cutting blade 17 secured in roller 14 and which periodically contacts the porous material once for each revolution of roller 14. The completed mask 18 drops into the open mouth of a chute 19 wherein the masks are stacked, compacted and advanced by a pivotal lever 20 driven by a pneumatic cylinder 21.

Figure 6:
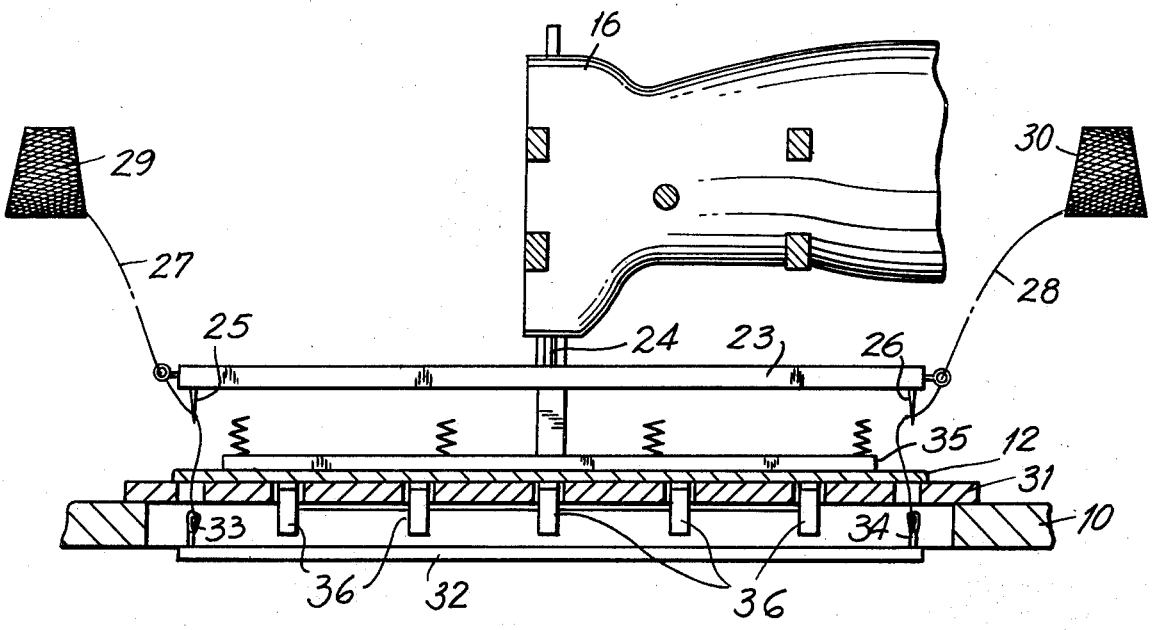
FIG. 6 is a sectional view taken on line 6—6 in FIG. 4.

Next to be described in more detail is the forming of the chain stitches 7 and the interweaving thereof with the cord material 8 of the ear loops. The sewing machine 16 is directly driven from an electric motor 22, said sewing machine being a conventional single thread chain stitch machine. The machine as used in the apparatus of the invention is a single thread chain stitch machine of the multiple needle type. As seen in FIG. 6 and as is entirely conventional and well known to those skilled in the art, the machine 16 is provided with a needle holder 23, adapted for attachment to needle bar 24 when two or more lines of chain stitches are to be formed. In the arrangement in FIG. 6 there are seen two needles 25, 26 mounted at the ends of holder 23 for forming the two lines of chain stitches 7. Each needle is supplied with respective thread 27, 28 from an associated supply spool 29, 30 of elastic thread material. The sewing machine 16 comprises a plate 31 on which the porous material 12 travels. Beneath the plate is a hook bar 32 on which are secured hooks 33 and 34, respectively aligned with needles 25 and 26. The needle holder 23 and hook bar 32 are driven by the sewing machine 16 such that the needles undergo up and down reciprocation while the hook bar travels fore and aft so that the two lines of chain stitches are formed. This is entirely conventional. The sewing machine also comprises a presser foot 35 which is spring-loaded downwardly, as in all conventional sewing machines, and a plurality of serrated feed dogs 36. Five such feed dogs have been shown, but in practice a greater number are employed.

In operation, when the needle holder 23 is lowered and the needles 25, 26 pierce the paper 12 to cooperate with the hooks 33, 34 to form a loop, the feed dogs are retracted and the presser foot 35 holds the paper stationary. Then, the needles are raised while the feed dogs are conjointly raised and advanced to feed the paper 12. When the needles descend again and they are introduced through the loops on the hooks and when they are again raised the chain stitch is formed. The operation is continuous, but involves intermittent feed and stoppage of the material 12. Again it must be emphasized that this is entirely conventional. However, concurrently with the intermittent paper feed of the sewing machine, the rollers 13 and 14 are constantly pulling on the paper to feed it through the nip of the rollers. In order to compensate for this feed difference, a spring-loaded idle roller 37 (FIGS. 4 and 5) is mounted on the table between the sewing machine 16 and the drive rollers 13 and 14. The drive rollers 13 and 14 operate in conjunction with the idle roller 37 and the sewing machine to maintain a taut condition on the paper while it is conveyed through the sewing machine and passed through the nip of the rollers 13 and 14.

Figure 8:
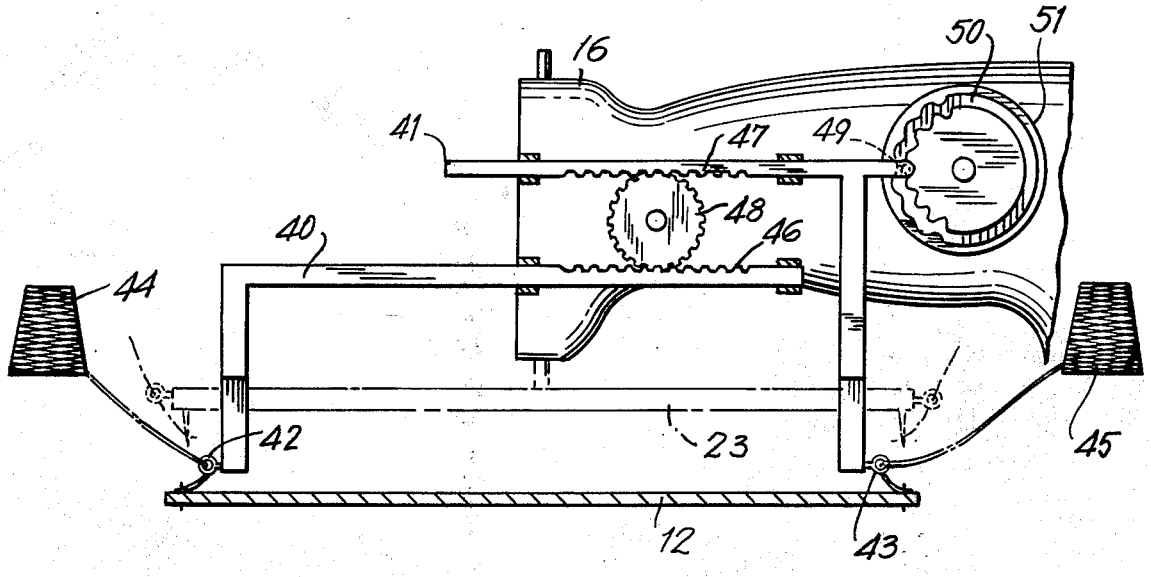
FIG. 8 is a front view of such portion.
Figure 9:
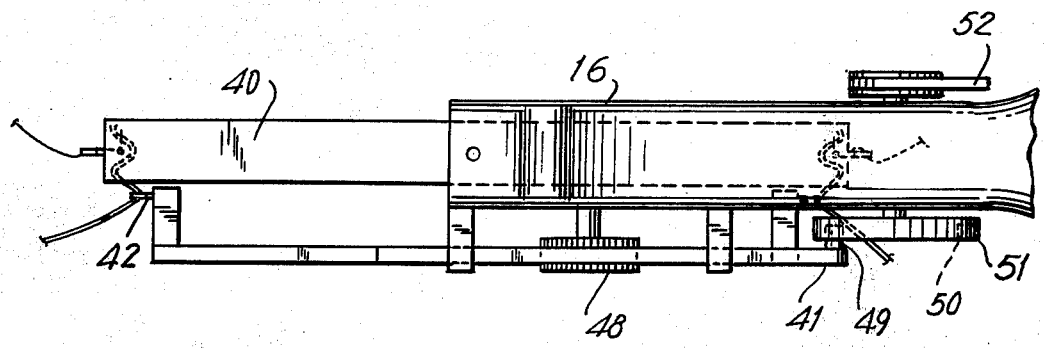
FIG. 9 is a top plan view of the portion shown in FIG. 8.

In the course of continuous formation of the line of stitches 7, the ear loop material is interwoven therewith at regions 8 as will be explained hereafter with particular reference to FIGS. 8 and 9.

Figure 7:
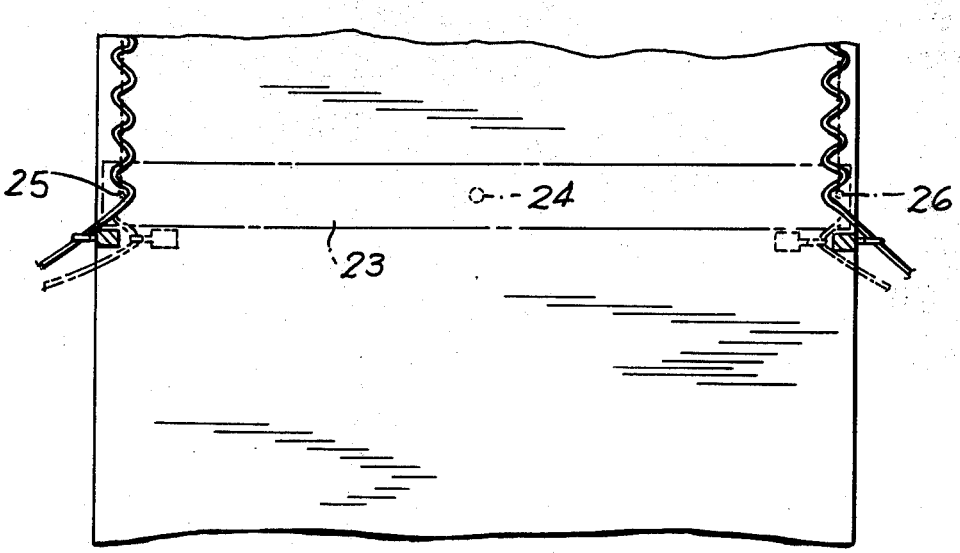
FIG. 7 is a diagrammatic top plan view of a portion of the machine for applying ear loop cords.

Therein can be seen transversely reciprocable bars 40, 41 slidably mounted on guides on the sewing machine 16 at a location immediately upstream of the needle holder 23. The reciprocable bars 40, 41 carry respective guide loops 42, 43 through which passes the ear loop material from a respective supply spool 44, 45. Bars 40 and 41 are formed with respective rack portions 46 and 47 in mesh with a freely rotatable pinion 48. The upper reciprocating bar 41 carries a roller 49 at its right free end which is engaged in a groove 50 of a face cam 51 mounted at the side of the sewing machine 16. The cam 51 is driven from the sewing machine through the intermediary of belt 52 and, in the course of rotation of the cam, the bars 40 and 41 are caused to undergo transverse reciprocation movement in opposite directions. The ear loop material passes from the supply spools 44 and 45 through the guides 42 and 43 into the line of stitches and as the bars 40 and 41 undergo transverse reciprocation, the ear loop material is guidably moved in alternation across the stitch lines in the manner as shown in FIG. 7, so as to be interwoven sinusoidally with the line of chain stitches 7.

The groove 50 of the face cam 51 is constructed to have a first portion with thirteen grooves and crests and a smooth portion extending over 17/30 of the circumferential extent of groove 50. Thus, for each revolution of the cam 51, the bars 40, 41 will undergo a first period of thirteen reciprocatory movements and a subsequent idle period. The drive of the cam is synchronized with the operation of the needle bar 23 so that during the reciprocating travel of the bars 40 and 41, thirteen stitches will be formed in the line 7 and, during the idle period, when the ear loop material is not interwoven with the stitches, seventeen stitches will be formed in line 7. This is evident from FIG. 13 wherein the continuous interweaving of the ear loop material with the line of stitches can be best seen. Herein is shown the formation of the thirteen interwoven loops of the cord material at 8 with the intervening free portion 9 corresponding to seventeen stitches formed in the line 7.

The profile of groove 50 and the positioning of the arms 40 and 41 is such that the guides 42 and 43 undergo transverse reciprocation on opposite sides of the respective lines of stitches 7 when the roller 49 comes into contact with the undulating portion of groove 50 and when the roller 49 contacts the smooth portion of the groove 50, the transverse arms 40, 41 remain stationary with the guide loops 42, 43 laterally outside the lines of stitches 7 and therefore there is no interweaving of the ear loop material with the line of chain stitches 7 so that the free intermediate portions 9 are formed.

Figure 13:
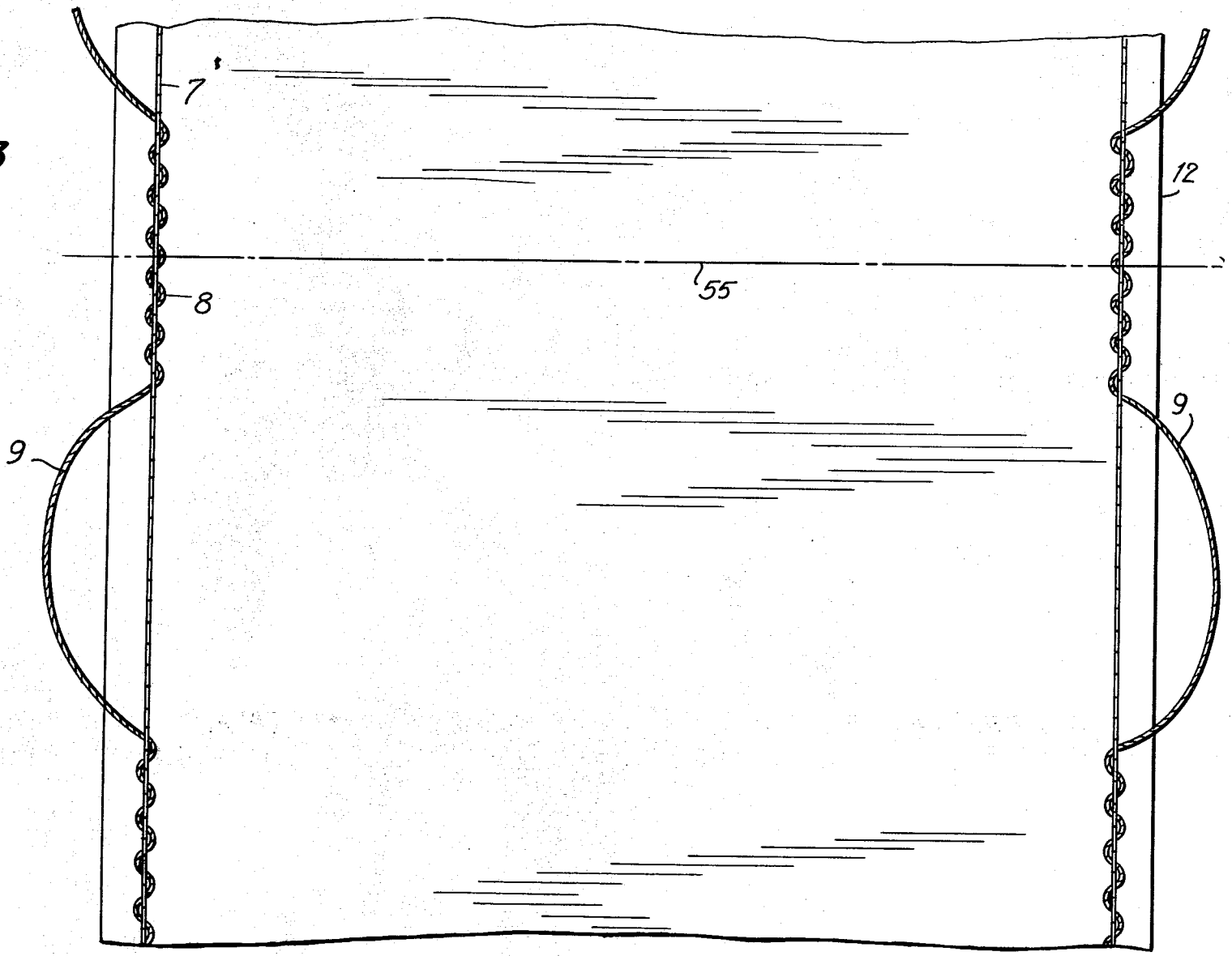
FIG. 13 is a plan view on enlarged scale showing the material with the loops and stitching therein advancing to the cutting means and the line of cut which is formed therein.

As the porous material with the line of stitches and interwoven ear loop material is transported beyond the sewing machine in the form as shown in FIG. 13, it will arrive at the rollers 13 and 14. These rollers are driven from the sewing machine in synchronization therewith so that blade 17 in roller 14 will effect a line of cut 55 (FIG. 13) exactly midway along the length of the thirteen interwoven stitches of the ear loop material with the line of stitches 7. As a consequence, the ear loop material of each mask will be interwoven at its ends 8 by six and one-half loops with the line of stitches and will loosely extend over an interval of seventeen stitches of line 7. It is to be noted that the ear loop material will be interwoven right up to the longitudinal edges of the mask, and this serves to anchor the ear loop material tightly to the porous material 12. The formation of the interwoven ear loops at 8 with stitches 7 greatly assists in tight securing of the ear loops to the material 12.

It is to be appreciated that since the material 12 is held taut throughout its travel from the roller 12 to the time it is cut, the elastic material for forming the chain stitches 7 and the elastic material of ear loops 9 will be interwoven with material 12 while the latter is taut. As soon as the material 12 is cut along line 55, the elasticity of the stitches 7 and the ear loop material serve to contract and gather the side edges of the mask to provide the configuration as shown in FIGS. 2 and 3 as previously described hereinabove. The approximate ratio of gather at the side edges is 2:1, and this is controlled by the adjustment of the tension of the elastic stitch material 7 and the ear loop material. Such a gather of material, i.e. shirring thereof, serves to shape the mask to the face of the user thereby facilitating its use.

The conjoint operation of feeding and cutting the porous material by rollers 13 and 14 will next be described in detail.

The roller 13 has twice the diameter of roller 14 and is driven at one-half the speed of roller 14. The drive of roller 13 is effected from sewing machine 16 through belt 61, speed reducing mechanism 62 and belt 63. The speed reducing mechanism provides a speed reduction of 60:1 so that each revolution of roller 13 corresponds to the length of two masks i.e. to a length of 60 stitches in line 7. The roller 14 is driven from roller 13 via gears 64 and 65 in a 2:1 ratio so that roller 17 will undergo one revolution for each 30 stitches in the length of line 7. In this way, the line of cut 55 will take place every 30 stitches to effect successive cutting of the masks from the continuous length of material 12 which is fed to the rollers 13, 14. The position of the radial cutting blade 17 in the roller 14 is correlated with the position of the line of cut 55, as shown in FIG. 13, so that the cut is made midway along the length of interweaving of the ear loop material at 8. A spring-loaded idler roller 66 is mounted adjacent roller 13 in order to hold the porous material 12 thereagainst so that it will be continuously fed into the nip between rollers 13 and 14.

A shaft of roller 17 is mounted in uprights 66' on table 10 so as to be capable of transverse sliding movement. A pneumatic cylinder 67 is connected to the shaft of roller 14 so as to effect transverse displacement thereof when the blade 17 comes into contact with the porous material between the rollers 13 and 14. It is the transverse movement of blade 17 which effectively produces a clean transverse cut in the porous material.

Mounted on the shaft of roller 14 is a spring 68 which acts in opposition to the thrust exerted by cylinder 67. The operation of cylinder 67 is effected through a pneumatic valve 69 as follows. Mounted on the shaft of roller 13 is a cam 70 (FIGS. 5 and 10) and this cam actuates the pneumatic valve 69 which connects the cylinder 67 to a pressure source (not shown) and accordingly, the cylinder 67 is operated to displace roller 14. The construction of the valve 69 is entirely conventional and may, for example, be of the type shown in U.S. Pat. No. 3,229,721. When the cylinder 67 is actuated, the roller 14 is transversely displaced against the opposition of spring 68 to effect cutting of the porous material by blade 17. When the cylinder 67 is deactivated by deactuation of valve 69, the spring 68 will return the roller 14 to its initial position. Hence, the roller 14 undergoes a reciprocatory movement for each cutting operation. It is to be noted that gear 65 mounted on the shaft of roller 14 remains in mesh with gear 64 during the entire course of the reciprocating movement, this being effected by making the width of gear 65 of sufficient dimension to accommodate such reciprocation.

Since the cylinder 67 must be activated twice for each revolution of roller 13, the cam 70 will carry two pins 71 diametrically opposed to one another in order to activate the pneumatic valve 69 once for each revolution of roller 14.

The blade 17 is replaceably mounted within the roller 14 and is adjustable therein in the following manner.

The blade is fixedly mounted in a carrier which is tightly engaged in a radial groove 72 formed along the length of roller 14. Three radial adjusting screws 73 are disposed along the length of roller 14 and engage the back of the blade carrier to effect proper longitudinal positioning of the edge of the blade 17 with respect to the surface of roller 14. Lock screws 74 serve to secure the adjusting screws 73 within roller 14. The shaft of the roller 14 is constituted by stub shafts 75, 76 secured in roller 14 beyond the end adjusting screws 71.

The roller 13 is an elastic material such as rubber or plastic and the roller 14 can be made of metal or plastic.

The individual masks, after having been cut by the blade 17 on roller 14, drop into the open mouth of chute 19. Pivotal lever or flap 20, at the mouth of the chute, is actuated once for each mask to press the same against a stack of masks within the chute 19. The flap 20 is activated by pneumatic cylinder 21, and the latter is controlled by a pneumatic valve 80 which is actuated by two diametrically opposed pins 71*a* on cam 70 so as to pivot flap 20 in synchronism with each deposit of a mask into the mouth of chute 19. The flap 20 is elastically biased so as to return to an initial position away from the mouth of chute 19 to permit the entry of the next cut mask thereinto. Such bias can be obtained by mounting a bias spring on the pivot shaft 81 of flap 20. The masks accumulate in the chute 19 and are continually pressed forward, once for each deposit of a mask, in the chute by flap 20, and a stack of masks are manually removed from the chute 19 through open top 82 thereof.

In order to facilitate removal of masks in a given number, e.g. in a stacked quantity of one-hundred, suitable marks are placed on the porous material once for each one-hundred masks which are being produced. In this way, the marks can be seen at the top edges of the masks through the open top 82 of the chute 19.

In order to apply the mark to the material, there is employed a marking means constituted by a marking brush 83 connected to the piston rod of a pneumatic cylinder 84. The pneumatic cylinder is activated once every hundred masks so as to project the marking brush 83 forwardly into contact with the advancing material 12, so as to render the mark visible on the mask at the open top 82 of chute 19.

The actuation of cylinder 82 once for each one-hundred masks is achieved by means of the arrangement visible in FIG. 10. Therein counter 85 is arranged to be actuated by pins 71*a* on cam 70 and hence, counter 85 will make one count for each mask being cut and delivered into chute 19. Counter 85 is of conventional type and will count down from a particular pre-set value and produce a signal when this value has been reached and then will automatically reset itself to the original pre-set value. Hence, by setting counter 85 to a value of 100, after 100 counts have been made, counter 85 will send a signal to pneumatic valve 86 to which it is connected, and valve 86 then activates cylinder 84 so as to bring the brush 83 into contact with the material 12. The operation of the marking cylinder 84 is synchronized with the rotation of cam 70 so that marking is effected on the mask material at a position immediately behind cut line 55 so that the mark which is made on the material will appear through the open top 82 of chute 19.

Although the invention has been described with reference to a specific embodiment thereof, it will become apparent to those skilled in the art that numerous modifications and variations can be made within the spirit and scope of the invention as defined in the appended claims.

Thus, for example, in forming the mask, two or more sheets of porous material can be sewn together at the lines of stitches 7 to produce a heavy-duty mask.

What is claimed is:

1. Apparatus for producing face masks from a roll of porous material, said apparatus comprising means for rotatably supporting the roll of material to permit unwinding thereof, driven roller means for pulling the material to unwind the material from the roll in taut condition, a sewing machine for sewing a longitudinal line of stitches along each of the opposite side edges of the material while the material is taut, means for periodically interweaving a cord along each side edge with the line of stitches to form alternate interwoven cord portions and intervening free loops of said cord, and cutter means for cutting the material transversely thereof at successive spaced locations at which the cord is interwoven with the line of stitches whereby to separate successive sections of porous material, with said loops of cord attached thereto, constituting face masks.

2. Apparatus as claimed in claim 1 wherein said driven roller means comprises a pair of rollers between which the material is caused to advance, said cutter means comprising a blade secured in one of said rollers.

3. Apparatus as claimed in claim 2 wherein said one roller is supported for transverse reciprocation, and means for reciprocably moving said one roller when the blade faces the other roller to effect a cutting action on said material.

4. Apparatus as claimed in claim 3 comprising means replaceably securing the blade in said one roller.

5. Apparatus as claimed in claim 4 wherein said blade extends radially in said one roller.

6. Apparatus as claimed in claim 1 wherein said means for periodically interweaving said cord with the line of stitches comprises a pair of transversely reciprocable bars each with a guide for leading a respective cord towards the line of stitches for interweaving therewith, and cam means for reciprocably moving said bars to interweave the cords with the line of stitches during one stage and for holding the cords displaced from the line of stitches in a succeeding idle stage during which the free loops are formed.

7. Apparatus as claimed in claim 1 comprising stacking means adjacent said roller means for receiving said masks one by one therefrom and stacking the same.

8. Apparatus as claimed in claim 7 comprising marking means coupled to said roller means for periodically marking the material.

9. Apparatus as claimed in claim 8 comprising counter means coupled to said roller means and said marking means to operate the marking means after a pre-determined number of masks have been produced.

10. A method of producing face masks from a roll of porous material comprising continuously unwinding the material from said roll while holding the material taut, forming a continuous line of stitches along both lateral edges of the material in the course of unwinding thereof, periodically interweaving a continuous elastic cord with each line of stitches in longitudinally spaced regions therealong while leaving said cord free between successive regions to form an ear loop thereat, and transversely cutting said material at successive locations through said regions where the cords are interwoven to separate successive sections of material with ear loops at its opposite edges constituting face masks.

11. A method as claimed in claim 10 wherein said material is cut substantially midway along the length over which the cord is interwoven with the stitches.

12. A method as claimed in claim 10 comprising stacking said masks after the transverse cutting of the material.

13. A method as claimed in claim 10 comprising marking the porous material after a given number of masks have been produced.

14. A method as claimed in claim 10 wherein said transverse cutting operation is effected by transversely reciprocating a cutting blade along said material.

* * * * *